US008857692B2

(12) United States Patent
Shima et al.

(10) Patent No.: US 8,857,692 B2
(45) Date of Patent: Oct. 14, 2014

(54) FASTENER DRIVING TOOL

(75) Inventors: Yukihiro Shima, Ibaraki (JP); Hideyuki Tanimoto, Ibaraki (JP); Hiroyuki Oda, Ibaraki (JP); Yoshihiro Nakano, Ibaraki (JP); Takashi Ueda, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 1177 days.

(21) Appl. No.: 12/352,886

(22) Filed: Jan. 13, 2009

(65) Prior Publication Data

US 2009/0179062 A1 Jul. 16, 2009

(30) Foreign Application Priority Data

Jan. 15, 2008 (JP) ..... 2008-005533

(51) Int. Cl.
*B27F 7/11* (2006.01)
*B25C 1/06* (2006.01)

(52) U.S. Cl.
CPC ..... *B25C 1/06* (2013.01)
USPC ..... 227/2; 227/110; 227/111

(58) Field of Classification Search
USPC ..... 227/2, 48, 4, 111
See application file for complete search history.

(56) References Cited

U.S. PATENT DOCUMENTS 3,243,023 A * 3/1966 Boyden ..... 192/223.2
3,682,254 A * 8/1972 Hoeffleur ..... 173/49
3,924,692 A * 12/1975 Saari ..... 173/117
4,161,272 A * 7/1979 Brockl ..... 227/131
4,724,992 A * 2/1988 Ohmori ..... 227/146
4,834,278 A * 5/1989 Lin ..... 227/7
6,604,666 B1 * 8/2003 Pedicini et al. ..... 227/131
6,796,475 B2 * 9/2004 Adams ..... 227/2
6,997,367 B2 * 2/2006 Hu ..... 227/132
7,513,402 B2 * 4/2009 Miyashita et al. ..... 227/8
7,543,728 B2 * 6/2009 Spasov et al. ..... 227/132
7,578,420 B2 * 8/2009 Tanimoto et al. ..... 227/132
7,694,863 B2 * 4/2010 Spasov et al. ..... 227/132
7,938,305 B2 * 5/2011 Simonelli et al. ..... 227/132
8,011,441 B2 * 9/2011 Leimbach et al. ..... 173/1
2004/0232194 A1 * 11/2004 Pedicini et al. ..... 227/131
2008/0006672 A1 * 1/2008 Tanimoto et al. ..... 227/132
2008/0017689 A1 * 1/2008 Simonelli et al. ..... 227/132
2008/0067213 A1 * 3/2008 Shima et al. ..... 227/129
2009/0179062 A1 * 7/2009 Shima et al. ..... 227/2

* cited by examiner

*Primary Examiner* — Thanh Truong
*Assistant Examiner* — Gloria R Weeks
(74) *Attorney, Agent, or Firm* — McDermott Will & Emery LLP

(57) ABSTRACT

When the plunger is a game moved to a prescribed position Ph of an initial state on the upper dead point side by the drive force of the motor after the plunger is moved to the lower dead point side, the controller of a spring driven-type fastener driving tool reduces the rotational speed of the motor to a prescribed value or less based on the detection signal of the operation detection switch and then stops the slowed down motor. In order to achieve this, the plunger is stopped at a stop position of an initial state that is as close as possible to an upper dead point side drive start position and is subjected to a strong compression force by the drive spring.

12 Claims, 13 Drawing Sheets

ROTATE THROUGH 135 DEGREES

ROTATE THROUGH 270 DEGREES

REVERSE ROTATED STATE

TIME
t0
t1
t2
t3
t4
t5
t6
t7

TRIGGER SWITCH
ON
OFF

PUSH SWITCH
ON
OFF

FIRST FET
ON
OFF
T2
Th

SECOND FET
ON
OFF
T1

DRUM ROTATION ANGLE
360°
180°
0°
200°
270°
150°
200°

DRIVE DETECTION SWITCH
ON
OFF

OPERATION DETECTION SWITCH
ON
OFF
UPPER DEAD POINT (Pm)

PLUNGER POSITION
(Pm/2)
Ph
Po
Ph
LOWER DEAD POINT (0)

FASTENER DRIVING TOOL

BACKGROUND OF THE INVENTION

1. Field of the Invention

The present invention relates to a fastener driving tool for fastening a fastener such as a nail, rivet, or staple to a member to be fastened.

2. Description of the Related Art

In the related art, spring driven type fastener driving tools employing electric motors are well-known. This type of spring driven type fastener driving tool uses the drive power of an electric motor to push up a plunger urged by a spring in a direction from a lower dead point to an upper dead point in a fastening direction in resistance to urging force of the spring. A fastener such as a nail is then driven into a member to be fastened by an accelerated plunger as a result of the plunger that has been pushed up being released.

This kind of spring-driven fastener driving tool moves the plunger up to an upper dead point side using a power transmission mechanism that is a combination of an electric motor and reduction gears. The plunger is then released from the upper dead point side to the lower dead point side so as to drive in the nail (fastener). After this, it is then necessary for the spring-driven fastener driving tool to again cause the plunger to move back to the initial position using the drive force of the electric motor. Driving of the motor is then stopped at this prescribed position by a reverse rotation prevention mechanism such as a one-way clutch and the drive cycle is complete.

However, recently, it has been necessary for spring driven type fastener driving tools to increase the force with which the plunger is urged by the drive spring, i.e. the spring energy has been increased in order to increase the drive impact force to make it possible to drive in larger nails.

However, when the spring energy is made large, the spring driven-type fastener driving tool causes the plunger to move rapidly in resistance to the large urging force of the spring from the lower dead point side to the upper dead point side by making the rotational speed of the electric motor, i.e. the spring compression speed fast. It is therefore necessary to make the plunger stop at a prescribed position after driving. However, making the spring compression speed fast causes variation in the plunger stop position, i.e. the spring compression distance, due to the rotational inertia of the motor and the power transmission mechanism caused by changes in the mechanical loss of the power transmission mechanism overtime etc. Variations in the plunger stop position occurring in the drive cycle are then the cause of variation in the spring compression time occurring in the next drive cycle. This means that the spring compression time varies, the spring compression can therefore becomes longer, and the driving feeling and drive efficiency therefore deteriorate.

In order to resolve the above problems, it is an object of the present invention to provide a highly reliable spring drive method the fastener driving tool that is capable of suppressing variation in the stop position of a plunger and is capable of improving the feeling when driving.

SUMMARY OF THE INVENTION

In order to achieve the above object, a fastener driving tool of a first aspect of the invention comprises:

a motor;

a DC power supply that supplies electrical power to the motor;

a magazine that supplies fasteners to a nose;

a plunger, arranged between an upper dead point and a lower dead point so as to be capable of moving up and down, having a blade for driving in the fasteners supplied to the nose;

a drive spring that urges the plunger downwards, and that is capable of being compressed upwards;

a spring compression drive unit that moves the plunger in a compression direction of the drive spring using the drive force of the motor, and that moves the plunger downwards by releasing the compressed spring;

a first operation switch that detects a first user operation;

a second operation switch that detects a second user operation;

an operation detection switch that detects a drive state of the spring compression drive unit; and a controller that controls the starting, stopping, and rotational speed of the motor based on detection signals from the first operation switch, the second operation switch, and the operation detection switch, wherein the controller reduces the rotational speed of the motor to a prescribed value or less and then stops the motor that has been reduced in speed based on the detection signal for the operation detection switching when the plunger is moved again to an initial position by a drive force of the motor after the plunger is moved to a lower dead point.

The controller reduces the rotational speed of the motor to a prescribed value or less based on a first detection signal from the operation detection switch indicating a first drive state of the spring compression drive unit, and stops the motor based on a second detection signal from the operation detection switch indicating a second drive state of the spring compression drive unit.

The operation detection switch outputs the first detection signal when the spring compression drive unit moves the plunger to a first prescribed position, and outputs the second detection signal when the spring compression drive unit moves the plunger to a second prescribed position that is closer to the direction of the upper dead point than the first prescribed position.

The controller reduces the rotational speed of the motor to the prescribed value or less by converting the voltage supplied by the DC power supply to the motor into a pulsed voltage.

A speed detection device that detects a rotational speed of the motor, wherein the controller modulates a pulse width of the pulsed voltage based on a rotational speed detected by the rotation speed detection device.

The controller controls the motor so that the time required for the plunger to move from the lower dead point to the initial position is within a range of 200 milliseconds to one second when the rotational speed of the motor is reduced to the prescribed value or less.

The first operation switch is a trigger switch that detects a trigger operation of user, and the second operation switch is a push switch that detects a contact of the nose with a member to be fastened.

The DC power supply supplies electrical power to the motor via a semiconductor switching element and, the controller reduces the rotational speed of the motor to the prescribed value or less by switching the semiconductor switching element on or off based on the detection signal from the operation detection switch.

The spring compression drive unit comprising a rotating body that moves in cooperation with the plunger and that rotates in a prescribed rotation direction based on the drive force of the motor, and a clutch that transmits or disengages the drive force of the motor to or from the rotating body, wherein the clutch:

transmits the drive power of the motor to the rotating body while the rotating body rotates to the prescribed angle in the prescribed rotation direction; and the clutch also disengages transmission of the drive force of the motor to the rotating body when the rotating body is rotated in the prescribed rotation direction so as to reach the prescribed angle, and the compression spring drive unit:

moves the plunger in the compression direction of the drive spring using the rotating body when the clutch is in a transmission state; and releases the compressed drive spring so as to move the plunger to the lower dead point when the clutch is switched over to a disengaged state.

The clutch transmits the drive power of the motor to the rotating body while the rotating body rotates in the prescribed rotation direction from a second prescribed rotation angle of the rotating body corresponding to the lower dead point position of the plunger to the prescribed angle.

The controller reduces the rotational speed of the motor to the prescribed value or less so that the initial position of the plunger is at a height that is half or more of the heights of the upper dead point and then stops the reduced speed motor.

Further, a fastener driving tool of a second aspect of the invention comprises: a motor;

a power supply that supplies electrical power to the motor;

a magazine that supplies fasteners to a nose;

a plunger, arranged between an upper dead point and a lower dead point so as to be capable of moving up and down, having a blade for driving in the fasteners supplied to the nose;

a drive spring that urges the plunger downwards, and that is capable of being compressed upwards;

a spring compression drive unit that moves the plunger in a compression direction of the drive spring using the motor, and that moves the plunger downwards by releasing the compressed drive spring;

an operation switch that detects a user operation;

an operation detection switch that detects a drive state of the spring compression drive unit;

a driving detection switch that detects driving of the fastener; and a controller that controls the motor based on detection signals from the operation switch, the operation detection switch, and the drive detection switch, wherein the controller reduces the speed of the motor when the operation detection switch detects that the plunger is moved to a first prescribed position by the spring compression drive unit after detection of driving of the fastener by the drive detection switch, and the controller stops the supply of electrical power from the power supply to the motor when the operation detection switch detects that the plunger is moved to a second prescribed position above the first prescribed position by the spring compression drive unit during rejection speed of the motor.

According to the present invention, it is possible to suppress variation in a plunger stop position and improve the feeling when driving.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Figure 1:
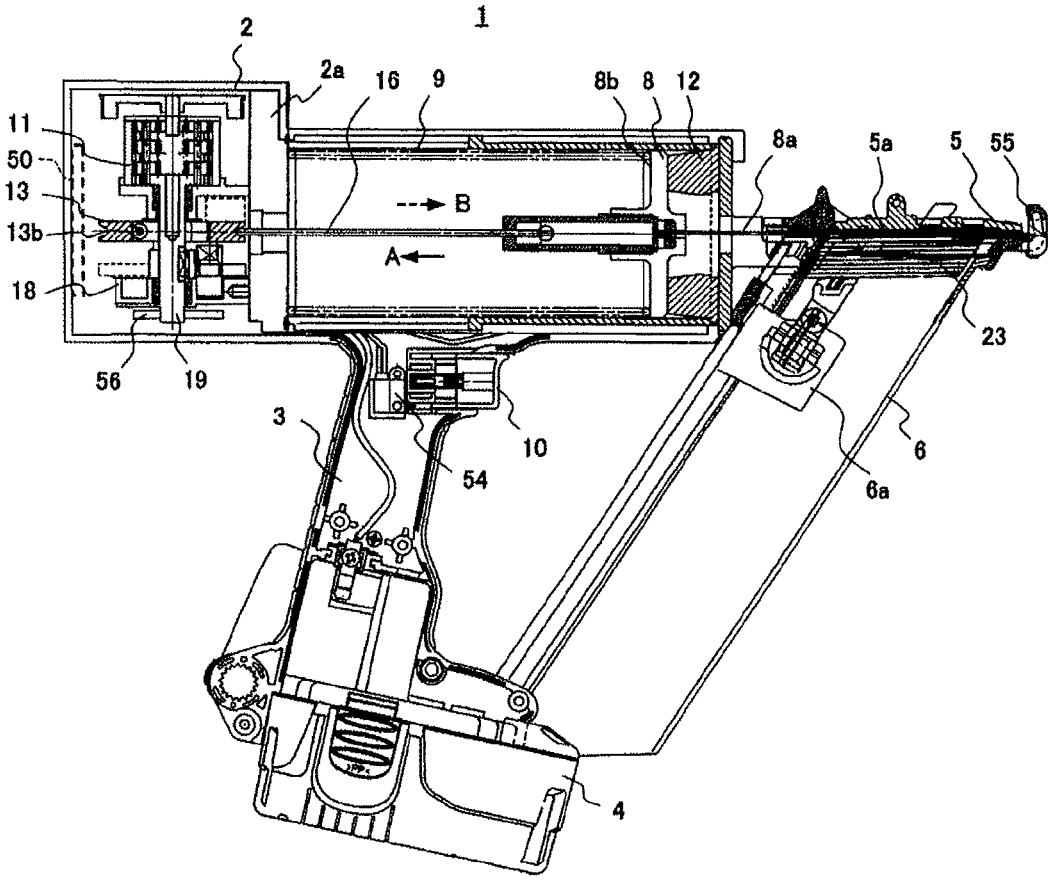
FIG. 1 is a side view including a partial cross-section of a fastener driving tool of an embodiment of the present invention.
Figure 2:
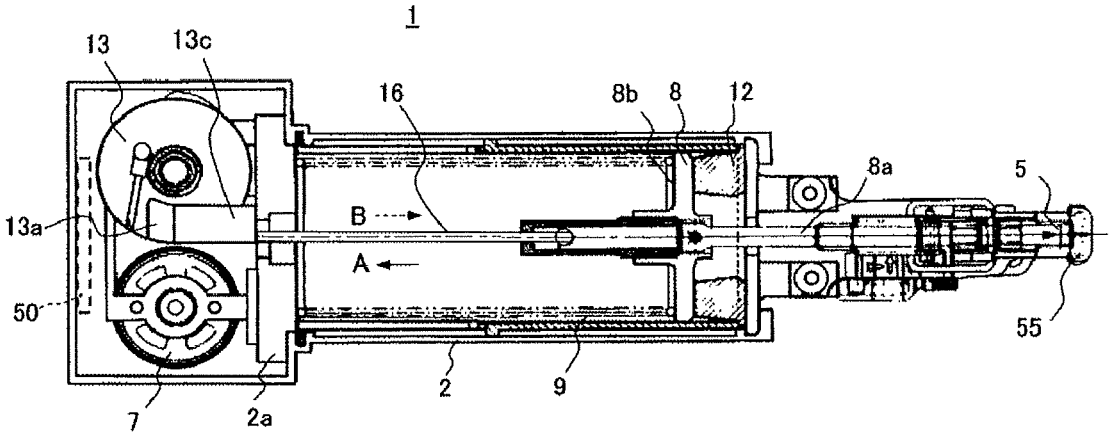
FIG. 2 is a plan view including a partial cross-section of the fastener driving tool shown in FIG. 1.

That described above and other objects of the present invention together with that described above and the characteristics will become clear from the following explanation of the specification and the appended drawings.

Best Mode for Carrying Out the Invention

The following is an explanation with reference to the drawings of a spring driven fastener driving tool of the embodiment of the present invention. In all of the drawings illustrating the embodiment, portions having the same function are given the same numerals and are not repeatedly described. In the following explanation of the fastener driving tool of the present invention, for convenience, the direction in which the fastener is driven is referred to as "downwards" and in the opposite direction to this direction is referred to as "upwards". These expressions of direction are in no way limiting with regards to special embodiments or intentions of the present invention are by no means limited to either direction of driving the fastener.

"Regarding the Assembly Configuration for the Fastener Driving Tool"

FIGS. 1 to 12 show structural views and circuit diagrams for a fastener driving tool of the embodiment. First, a description is given of the overall structure of the fastener driving tool with reference to FIGS. 1 to 3.

The fastener driving tool 1 includes a fuselage housing unit 2, a handle housing unit 3, a battery pack (storage battery) 4, a nose (ejection section) 5, and a magazine 6. The handle housing unit 3 can be provided so as to branch off from the fuselage housing unit 2. The battery pack 4 is installed at an end of the handle housing unit 3 detachably and is electrically connected to an electric motor 7 (refer to FIGS. 2 and 3). The nose 5 is provided at the tip (lower end) in a fastener driving direction of the fuselage housing unit 2. The magazine 6 is loaded with nails 23 constituting fasteners that are connected together and supplies the fasteners 23 one at a time to within an ejection section path 5*a* of the nose 5.

A plunger 8, a drive spring (coil spring) 9, the motor 7, a reduction mechanism unit 80 (refer to FIG. 3), a spring compression release drive unit 81 (simply referred to as "spring compression drive unit" in the following) (refer to FIG. 3), and a controller (control circuit device) 50 (refer to FIG. 11) are built into the fuselage housing unit 2. The drive spring 9 provides striking power (firing power) to the plunger 8 and the reduction mechanism unit 80 reduces the rotation of the motor 7 and outputs a large torque. The spring compression drive unit 81 is driven by the motor 7, and compresses and releases the drive spring 9. As described in the following, the spring compression drive unit 81 includes a wire or rope (hoisting connecting line) 16, a drum (rotating body) 13, a drum hook 22, a pin support plate 21, a power transmission pin 17, and a guide plate 18.

Figure 3:
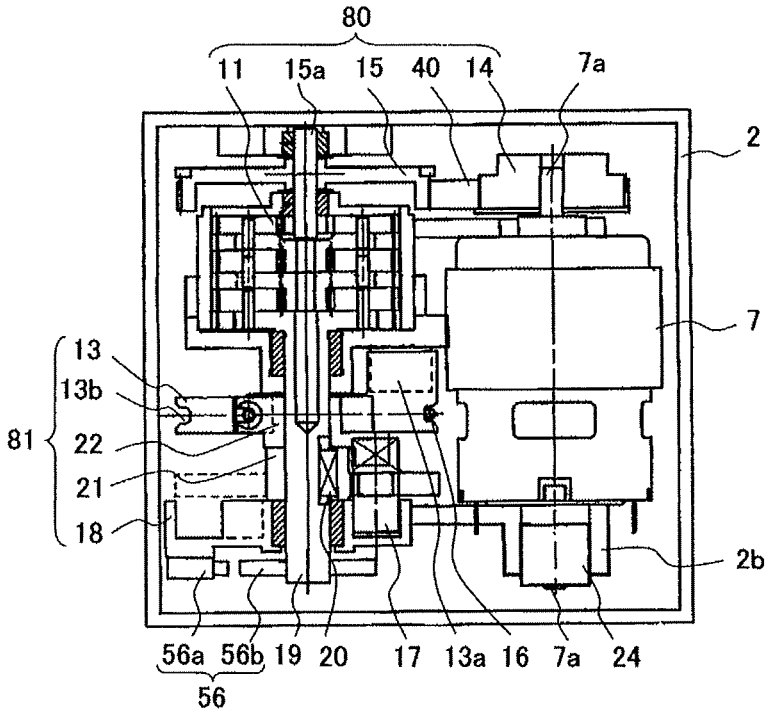
FIG. 3 is a rear view including a partial cross-section of the fastener driving tool shown in FIG. 1.

As shown in FIG. 1, the handle housing unit 3 takes a side of the fuselage housing unit 2 as a base and extends from the outer periphery of the fuselage housing unit 2. A trigger switch 54 having a trigger 10 operated by the user is provided at the base. The trigger switch 54 is electrically connected to the motor 7 (refer to FIG. 2) and the controller 50, and controls driving of the motor 7. The battery pack 4 is installed at an end of the handle housing unit 3. The battery pack 4 then supplies electrical power to the motor 7 and the controller 50 via the wiring arranged within the handle housing unit 3. The controller 50 has a semiconductor switching element (FET) (not shown) built-in for turning the current of the motor 7 on and off. As shown in FIG. 3, the control circuit device 50 includes an operation detection switch (stop switch) 56 (refer to FIG. 11) that senses the operation of the plunger 8 from the rotation angle of a rotation output shaft 19 (drum 13) of the deceleration mechanism 81 and controls stopping of the motor 7. As shown in FIG. 3, the operation detection switch 56 is a micro switch including a switch unit 56*a* fixed to the guide plate 18 (fuselage housing unit 2) and a rotation thrust unit (cam unit) 56*b* installed at the rotation output shaft 19 that makes the switch unit go on or off at prescribed rotation angles of the rotation output shaft 19. A detection signal for whether the operation detection switch 56 is on or off is inputted to the controller 50 (refer to FIG. 11).

As shown in FIG. 1, the magazine 6 is provided so as to have one end positioned at the nose 5 and another end positioned at the handle housing unit 3. A large number of nails 23 that are the fasteners are loaded one next to another within the magazine 6 in the direction of extension of the magazine 6. The connected nails 23 are then pressed to the side of the nose 5 by a feeding member 6*a* so that the end of the nail 23 is positioned within the ejection section path 5*a* of the nose 5. This means that the nail 23 positioned within the ejection section path 5*a* is then struck by the tip of a blade 8*a* when the tip of the blade 8*a* moves within the ejection section path 5*a* of the nose 5. The nail 23 is then pushed out from the ejection section path 5*a* of the nose 5 so as to be driven into the member to be fastened (not shown). The struck nail is then accelerated by the plunger 8 (blade 8*a*) up to making contact with the member to be fastened as a result of making the length of the ejection section path 5*a* of the nose 5 longer than the length of the driven nail. It is therefore possible to strike the nail 23 with strong striking power. A push switch (push lever) 55 can be provided at the tip of the nose 5. The push switch 55 then detects that the tip of the nose 5 is substantially in contact with the member to be fastened. At the controller 50 (refer to FIG. 11), the push switch 55 functions as an operation switch that controls driving of the motor together with the trigger switch 54 that detects operation of the trigger 10 and inputs a control signal that is off or on to the controller 50.

As shown in FIG. 1, the plunger 8 is arranged so as to be capable of being moved vertically both upwards (arrow A) or downwards (arrow B) between an upper dead point side and a lower dead point side within the fuselage housing unit 2. The plunger 8 has a blade (driver bit) 8*a*. When the plunger 8 moves to the side of the lower dead point (direction B), the tip of the blade 8*a* extends to as far as the tip of the ejection section path 5*a* defined within the nose 5 that the nail 23 is loaded into. The coil spring 9 is then installed in a compressed state between an upper surface section of a plunger plate 8*b* of the plunger 8 on the upper dead point side and a wall section 2*a* encompassing the spring compression drive unit 81 described later. The spring 9 is then compressed when the plunger 8 is wound to the side of the upper dead point as a result of the wire 16 B is wound up by the spring compression drive unit 81. This means that the plunger 8 is pushed by a stronger urging force with respect to the direction (driving direction) B of the lower dead point side.

As shown in FIG. 3, the reduction mechanism unit 80 is connected to the motor 7. The reduction mechanism unit 80 includes a first pulley 14 fitted to a rotation output shaft 7*a* of the motor 7, a belt 40, a second pulley 15, and a planetary gear unit 11. The first pulley 14 and the second pulley 15 constitute a first reduction unit that reduces the rotation of the rotation output shaft 7*a* of the motor 7 using the rotation of a rotation output shaft 15*a* of the second pulley 15. The planetary gear unit 11 includes a three-stage planetary gear unit connected to the rotation output shaft 15*a* of the second pulley 15. The planetary gear unit 11 constitutes a second reduction unit that reduces rotation of the rotation output shaft 15*a* of the second pulley 15 using rotation of the rotation output shaft 19 of the planetary gear unit 11. As described in the following, the drum 13 is driven by a rotation force obtained through reduction at the rotation output shaft 19 of the planetary gear unit 11 (second reduction unit). The drum 13 winds up the wire 16 so as to move the plunger 8 to the upper dead point direction. The reduction mechanism unit 80 reduces the rotation occurring at the rotation output shaft 7*a* of the motor 7 and transmits the rotation to the rotation output shaft 19 of the drum 13. The torque (rotational power) of the motor 7 is therefore amplified at the rotation output shaft 19 of the drum 13 as a result of this reduction. The compression mechanism for the spring 9 can therefore be adopted as a configuration applied to a small type motor taken as the motor 7. For example, a reduction ratio between the rotation output shaft 7*a* of the motor 7 and the rotation output shaft 19 (rotation output shaft 19 of the reduction mechanism unit 80) of the drum 13 is 150 to 300.

As shown in FIG. 3, the one-way clutch (reverse rotation prevention mechanism) 24 is provided at the other end of the rotation output shaft 7*a* of the motor 7. The one-way clutch 24 is fixed to the fitting section 2*b* of the fuselage housing unit 2. The one-way clutch 24 then permits the motor 7 (the drum 13) to rotate only in the forward rotation direction (direction A) and prevents the motor 7 from rotating in the opposite direction of rotation (direction B). Namely, when a torque is applied to the rotation output shaft 7*a* of the motor 7 so as to rotate the drum 13 in a direction B opposite to the direction A for winding up the wire 16, this reverse rotation torque is overcome, and the rotation in the opposite direction B is prevented. When a rotation torque in the forward direction A is applied, rotation (idling) in the forward direction A for the motor 7 with respect to a torque of a loss torque or more is permitted. A roller-type (roller type) clutch or a ratchet type clutch is applicable as the one-way clutch 24.

[Configuration for Assembling the Spring Compression Drive Unit 81]

Figure 4:
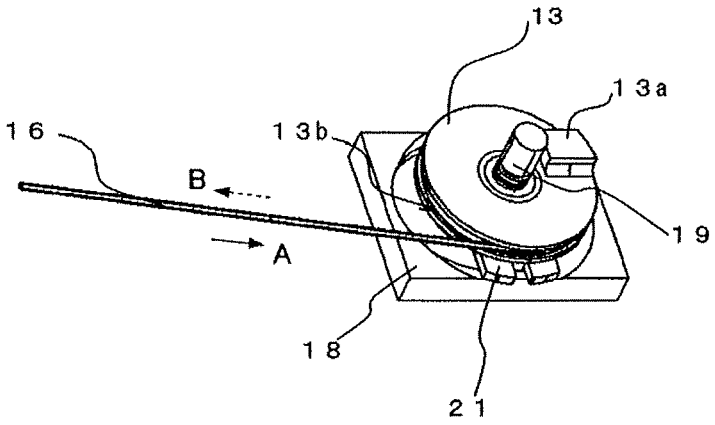
FIG. 4 is a perspective view of a spring compression drive unit constituting the fastener driving tool shown in FIG. 3.
Figure 5:
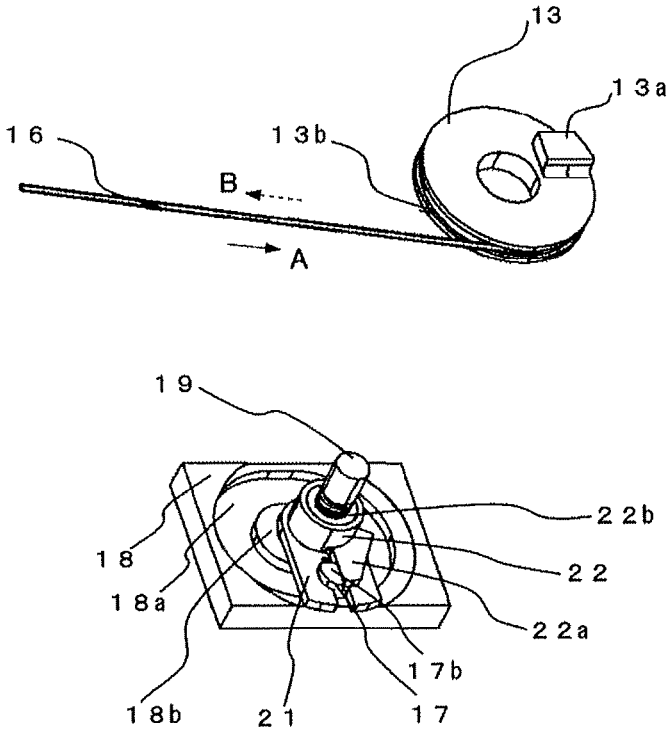
FIG. 5 is a partially enlarged perspective view of the spring compression drive unit shown in FIG. 4.
Figure 6:
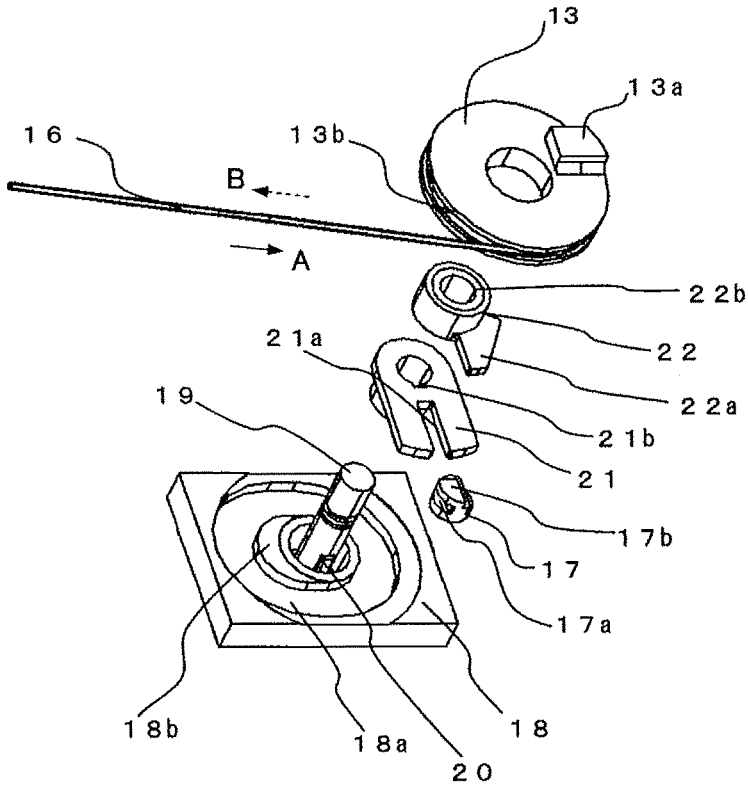
FIG. 6 is a partially enlarged perspective view of the whole of the spring compression drive unit shown in FIG. 4.

As shown in FIGS. 4 to 6, the spring compression drive unit 81 for compressing and releasing the spring 9 includes the guide plate 18 that supports one end of the rotation output shaft 19 of the planetary gear unit 11, the pin support plate 21, the drum hook 22, the drum 13, the power transmission pin 17 slidably supported at the pin support plate 21, and the wire 16 connecting the drum 13 and the plunger 8.

The spring compression drive unit 81 rotates the drum 13 using the drive force of the motor 7 in the prescribed direction A from a reference state (rotation angle zero degrees) to as far as a prescribed rotation angle (for example, 270 degrees). The drum 13 winds up the wire 16 while rotating so as to move the plunger 8. This means that the spring compression drive unit 81 therefore compresses the drive spring 9. When the drum 13 reaches a prescribed rotation angle 270 degrees, the spring compression drive unit 81 disengages the engagement of the rotation output shaft 19 of the reduction mechanism unit 80 and the rotating shaft of the drum 13. As a result, the drum 13 is supported in a freely rotating manner with respect to the rotation output shaft 19 and rotation in the reverse rotation direction B is therefore possible. When the drum 13 is supported in a freely rotating manner, the drum 13 rotates in the reverse rotation direction B as a result of the urging force of the spring 9. Further, the compressed spring 9 is then rapidly released and the blade 8*a* of the plunger 8 strikes the nail 23. Namely, the spring compression drive unit 81 has a function that transmits the motor drive force obtained at the rotation output shaft 19 of the reduction mechanism unit 80 to the drum 13 and compresses the spring 9, and a function that disengages the transmission of the motor drive force to the drum 13 and releases the compressed spring 9.

A detailed description is now given of the spring compression drive unit 81 with reference to FIGS. 4 to 6. The wire 16 used as a winding up connecting line is constructed, for example, by binding a plurality of metal wiring material so as to combine both flexibility and strength. The surface of the wire 16 is coated with resin so as to prevent wear at a drum groove (trough) 13*b* making contact with the wire 16. The outer peripheral section of the cylindrical section of the drum hook 22 is press-fitted into a center hole of the drum 13 and the drum hook 22 and the drum 13 are formed integrally. A bearing (for example, a ball bearing) 22*b* is press-fitted at an inner peripheral surface of the cylindrical section of the drum hook 22 and the bearing 22*b* is installed at the rotation output shaft 19. This means that the drum 13 and the drum hook 22 both become integral and are supported so as to be rotatable with respect to the rotation output shaft 19.

The power transmission pin 17 has a pin slide section (groove section) 17*a* that engages with the pin support plate 21 and a pin hooking section 17*b* that engages with a hook section 22*a* of the drum hook 22. The pin slide section 17*a* engages with the pin support slide section 21*a* in the possession of the pin support plate 21 so as to be slidable. The power transmission pin 17 is arranged so that its side end surface makes contact with a wall section within a guide channel 18*a* of the guide plate 18. The direction and extent of movement of the power transmission pin 17 is controlled by the plane shape of the guide channel 18*a*. The pin hooking section 17*b* that is the other end surface of the power transmission pin 17 is installed at the same height as the height of the hook section 22*a* in the axial direction of the rotation output shaft 19. When the power transmission pin 17 rotates in synchronization with the pin support plate 21, the pin hooking section 17*b* engages with the hook section 22*a*. The pin support plate 21 has a key groove 21*b*, with a key 20 provided at the rotation output shaft 19 engaging with the key groove 21*b*. The rotation output shaft 19, the pin support plate 21, and the power transmission pin 17 are therefore configured so as to always rotate in synchronization with each other.

[Operation of the Spring Compression Drive Unit 81]

FIGS. 7 to 10 show the state of rotation of the drum 13 when the spring compression drive unit 81 is in operation. For the convenience of description, the drum 13 coupled to the drum hook 22 by press fitting is shown in a removed state in FIGS. 7 to 10.

Figure 7:
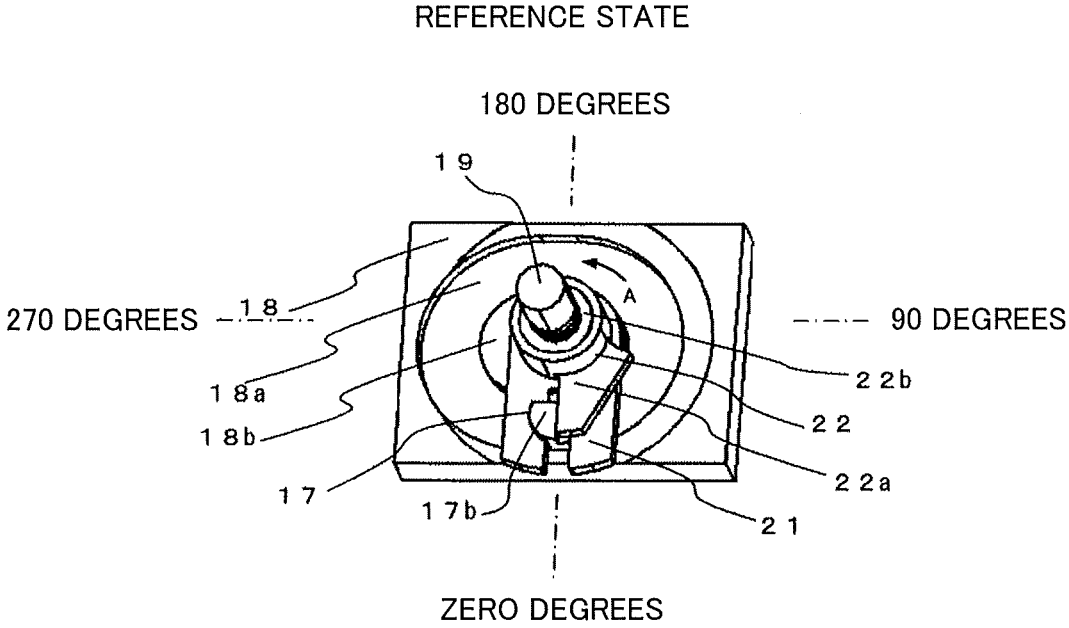
FIG. 7 is a perspective view of a reference state for the spring compression drive unit shown in FIG. 5.
Figure 8:
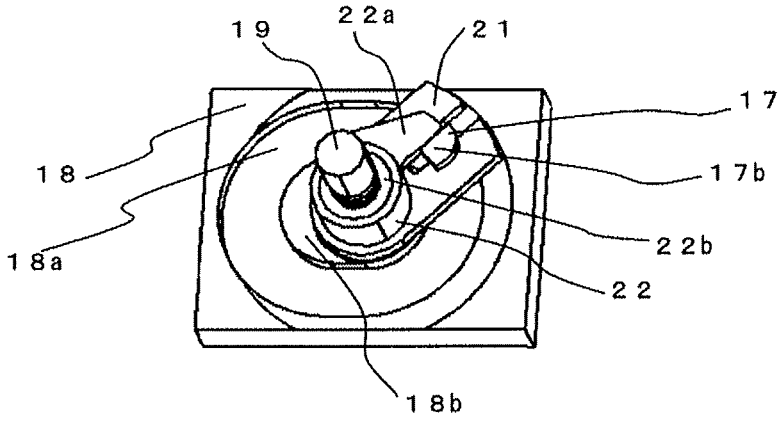
FIG. 8 is a perspective view showing the spring compression drive unit shown in FIG. 5 rotated through 135 degrees.
Figure 9:
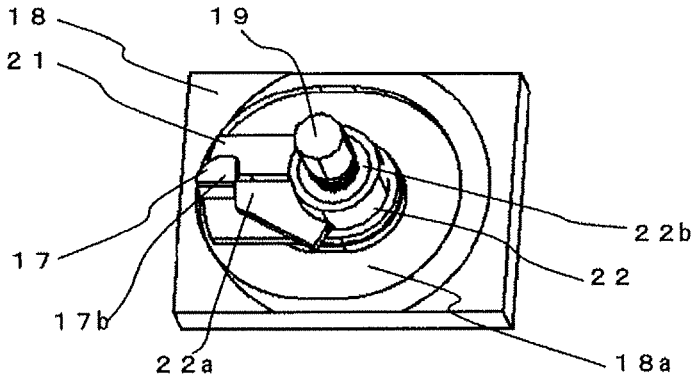
FIG. 9 is a perspective view showing the spring compression drive unit shown in FIG. 5 rotated through 270 degrees.
Figure 10:
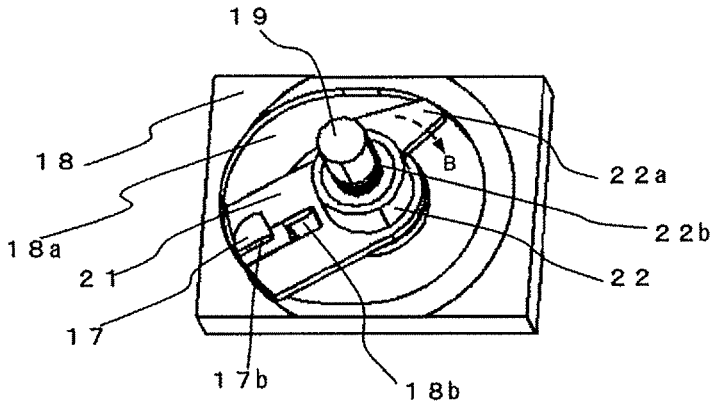
FIG. 10 is a perspective view showing the spring compression drive unit shown in FIG. 5 when rotated in reverse.

FIG. 7 shows the case where the hook section 22*a* (pin hooking section 17*b*) of the drum hook 22 is in a reference state at a position where the rotation angle is zero degrees. In this reference state, the plunger 8 is stopped at the lower dead point. FIG. 8 shows the situation when the hook section 22*a* (pin hooking section 17*b*) is rotated through approximately 135 degrees in the forward rotation direction A. FIG. 9 shows the situation when the hook section 22*a* (pin hooking section 17*b*) is rotated through approximately 270 degrees in the forward rotation direction A. FIG. 10 shows the situation where the hook section 22*a* is released from engagement with the pin hooking section 17*b* and the drum 13 is rotated in reverse in the reverse rotation direction B as a result of being urged by the spring 9 towards the plunger 8.

As a result of the above configuration, the plunger 8 urged by the spring 9 is pushed upwards to a prescribed position on the upper dead point side (drive start position) as a result of the action of the motor 7, the reduction mechanism unit 80, and the spring compression drive unit 81, while resisting the urging force (firing power) of the spring 9. The spring 9 compressed to the prescribed upper dead point position by the spring compression drive unit 81 is then released. The urging force (firing force) obtained at the time of release then acts on the blade 8*a* fitted to the plunger 8 so as to provide an impact force via the blade 8*a* to the nail 23 loaded in the magazine 6. The nail 23 can therefore be driven in the direction of the member to be fastened from the nose 5. Next, a detailed description is now given of the operation of the spring compression drive unit 81 with reference to FIGS. 7 to 10.

When the plunger 8 is in the reference state where the plunger 8 is stopped at the lower dead point (refer to FIG. 1), the plunger 8 is pushed down to the lower dead point by the urging force of the spring 9. The pin hooking section 17*b* driven by the drum 13 that winds up the wire 16 is, for example, the reference position, as shown in FIG. 7. When an operator grasps the handle housing unit 3 of the fastener driving tool 1, pulls back the trigger switch 10 so as to put the trigger switch 54 on, and presses the push switch 55 provided at the tip of the nose 5 against the member to be fastened, electrical power is supplied from the battery pack 4 to the motor 7 by the function of a controller 50 described later. The motor 7 (refer to FIGS. 2 and 3) then rotates in the forward rotation direction A. As shown in FIG. 3, the rotational force of the motor 7 is transmitted to the rotation output shaft 15*a* of the first reduction unit constituted by the first pulley 14 fitted to the rotation output shaft 7*a*, the second pulley 15, and the belt 40 wrapped across the first pulley 14 and the second pulley 15. The rotational force of the motor 7 is then transmitted to the rotation output shaft 19 by a second reducing unit constituted by the three stage planetary gear unit 11. The rotational force of the motor 7 is then transmitted to the pin support plate 21 which is mechanically engaged with the rotation output shaft 19 and the power transmission pin 17. At this time, the motor 7 rotates in the forward rotation direction A. The one-way clutch 24 therefore idles and rotation of the motor 7 in the forward rotation direction A is permitted.

As shown in FIG. 7, the power transmission pin 17 and the hook section 22*a* are in engagement in the reference state of the spring compression drive unit 81. The pin support plate 21 therefore receives the rotational force of the motor 7 so as to rotate, and the drum hook 22 and the drum 13 rotate in the forward rotation direction A. The drum 13 then winds up the wire 16 onto a drum trough section 13*b* provided at the outer surface of the drum 13 during rotation of the drum 13 in the forward rotation direction A. When the wire 16 is wound onto the drum 13 in the direction A, the plunger 8 coupled to the end of the wire 16 is pushed upwards towards the upper dead point side against the urging force of the spring 9. The plunger 8 is then moved towards the upper dead point side, and compress the spring 9 by the plunger plate 8*b* while the spring 9 resisting a substantial urging force.

FIG. 8 shows the situation when the hook section 22*a* is rotated through approximately 135 degrees from the reference position shown in FIG. 7. The drum 13 is also rotated through approximately 135 degrees in synchronism with the rotation of the pin support plate 21, the wire 16 is wound up, and the spring 9 is compressed. A side end of the power transmission pin 17 comes into contact with a guide projection 18*b* that defines an inner wall section of the guide channel 18*a* in accordance with the pin support plate 21 being rotated from this state of being rotated through 135 degrees as shown in FIG. 8 to a state of being rotated through approximately 270 degrees as shown in FIG. 9 as a result of the rotation of the motor 7. The guide projection 18*b* is substantially elliptical in shape with a planar shape that bulges by approximately 5 to 15 millimeters in a radial direction from the center of its axis of rotation. As the pin support plate 21 rotates, the power transmission pin 17 moves in a radial direction along the external shape of the guide projection 18*b* so as to become more distant than the rotation output shaft 19.

When the pin support plate 21 enters a state of rotation of approximately 270 degrees (FIG. 9) from the reference state in FIG. 7, the power transmission pin 17 moves approximately 5 to 15 millimeters in the radial direction. The connection (engagement) between the power transmission pin 17 and the hook section 22*a* is therefore released. As shown in FIG. 9, when the drum 13 is rotated through approximately 270 degrees from the initial state, the plunger 8 is lifted as far as a maximum position (refer to FIG. 13 H) on the upper dead point side by the wire 16 and the spring 9 also enters a state of maximum compression.

When the connection between the power transmission pin 17 and the hook section 22*a* is released in a state of rotation through approximately 270 degrees as shown in FIG. 9, the compressed spring 9 is released, and the plunger 8 moves towards the lower dead point side due to the force released from the spring 9 (firing force). As shown in FIG. 10, when the plunger 8 moves to the lower dead point side, the drum 13 and the drum hook 22 are pulled by the wire 16 and rotation in the opposite direction B to the forward rotation direction A of the rotation output shaft 19 commences.

When the drum 13 is rotated in reverse in the direction B by the force released from the compressed spring 9 so that the plunger 8 reaches the lower dead point, the blade 8*a* fitted to the end of the plunger 8 passes through the ejection section path 5*a* of the nose 5 and therefore drives the nail 23 towards the member to be fastened. When the drum 13 returns to the reference state at the same time as the driving, the drum damper engaging section 13*a* of the drum 13 engages with the drum damper 13*c* shown in FIG. 2. The drum 13 and the drum hook 22 then reengage at the reference position as shown in FIG. 7.

As described in the following, even after the nail 23 is driven in, the motor 7 is driven for a prescribed time by the controller 50. The drum 13 is therefore made to rotate in the forward rotation direction A again as a result of the reengagement of the power transmission pin 17 and the hook section 22*a*. The drum 13 then winds in the wire 16 so that the plunger 8 is moved to a prescribed position. The spring 9 is then compressed so as to have a prescribed urging force. According to this embodiment, when the drum 13 is rotated so that the rotation angle of the drum 13 becomes approximately 150 degrees, the controller 50 reduces the operation of the motor 7 based on the detection signal of the operation detection switch 56. The controller 50 then reduces the speed of the drum 13 and then stops the drum 13 after the speed has been reduced (stops the supply of current). The one-way clutch 24 (refer to FIG. 3) is therefore prevented from rotating in the reverse rotation direction B. The final rotation of the drum 13 in the driving cycle is stopped in a position at approximately 200 degrees so as to enter the initial state for the next drive cycle.

The timing of stopping the motor 7 is after the timing that the operation detection switch 56 (refer to FIG. 3) detects a prescribed rotation angle of the drum 13 occurring in the forward rotation direction A. Even if the motor 7 is stopped at this timing, the drum 13 continues to rotate as a result of the rotation inertia of the rotor (not shown) of the motor 7, the planetary gear unit 11, and the rotation output shaft 19, and the drum 13 therefore rotates as described above. The drum 13 pushes the plunger 8 up and causes the spring 9 to further be compressed until the drum 13 stops.

[Circuit Configuration for the Controller 50]

Figure 11:
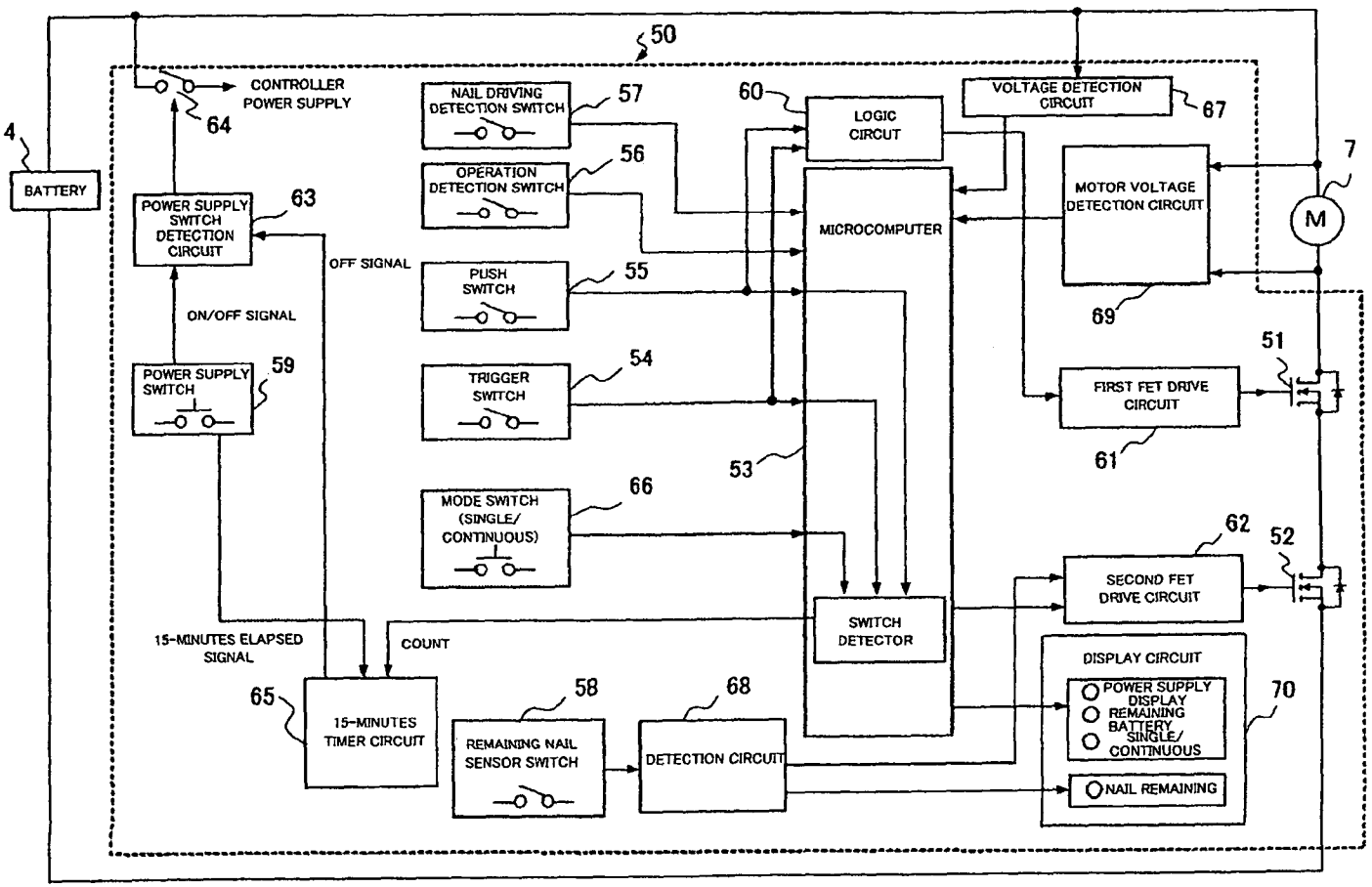
FIG. 11 is a block diagram of a controller used by the fastener driving tool shown in FIG. 1.

Next, an explanation is given with reference to FIG. 11 of a circuit configuration for the controller 50.

A battery of the battery pack 4 is, for example, a lithium ion secondary battery that is a power supply Vcc supplying electrical power to the motor 7 (for example, a DC motor) and the controller 50. A first semiconductor switching element 51 and a second semiconductor switching element 52 connected together in series are connected across the motor 7 and the battery pack 4. For example, an N-channel insulating gate-type FET is applicable as the semiconductor switching elements 51 and 51. In the following explanation, the first semiconductor switching element 51 and the second semiconductor switching element 52 are respectively described as a first FET 51 and a second FET 52. This means that is it possible to prevent nails being carelessly driven even when the conductive state of either one of the semiconductor switching elements fails as a result of becoming thermally damaged because a pair of the first FET 51 and the second FET 52 are connected in series. This gives a high level of reliability because of the high-level of redundancy. The power supply switch 64 of the controller 50 is controlled to go on and off by the output of a power supply switch detection circuit 63 that detects the operation of a power supply switch 59 and supplies or ceases the supply of power to the controller 50.

The controller 50 includes a first FET drive circuit 61 for driving the first FET 51 and a second FET drive circuit 62 for driving the second FET 52, a motor voltage detection circuit 69 that detects the rotational speed of the motor 7 as electromotive force of the motor, and a display circuit 70 that displays the throwing on of the power supply, the amount of battery remaining, single/consecutive mode, and nails remaining. Further, the controller 50 includes a logic circuit 60 for forming a control signal for the first FET drive circuit 61, a remaining nails sensor switch 58 that detects the quantity of consecutive nails 23 (for example, 0 to 5) loaded in the magazine 6, a detection circuit 68 that detects the output of the remaining nails sensor switch 58, and a 15-minute timer circuit 65 that counts whether or not a prescribed time has elapsed (for example, 15 minutes) from the power supply switch 59 going on.

The controller 50 includes a microcomputer 53. A signal inputted as a control signal for the microcomputer 53 is a signal that is respectively outputted from a voltage detection circuit 67 that detects the voltage of the battery pack 4, the trigger switch 54 that detects a pulling operation of the trigger 10, the push switch 55 that detects whether or not the nose 5 is pushing the member to be fastened, the operation detection switch (stop switch) 56 that detects whether or not the rotation of the drum 13 has been restored to a prescribed angle after driving in the nail, a nail driving detection switch 57 that detects whether rotation of the drum 13 in the forward rotation direction A has rotated as far as a nail driving rotation angle (for example, 270 degrees), and a mode switch 66 that selects a nail driving mode to be single or continuous. The operation detection switch 56 is provided for stopping operation of the motor 7 so that the plunger 8 is made to stop at an appropriate upper dead point side position in resistance to the urging force of the spring 9.

The microcomputer 53 outputs the control signal to the second FET drive circuit 62 based on input signals of the various operation switches and detection circuits, and outputs various display signals to the display circuit 70 while simultaneously carrying out appropriate rotation control of the motor 7. When there is an input signal from the trigger switch 54, the push switch 55, and the mode switch 66, the microcomputer 53 outputs a count reset signal to the 15-minute timer circuit 65. When the power supply is turned on at the controller 50 as a result of the on operation of the power supply switch 64, the 15-minute timer circuit 65 automatically starts counting. When 15-minutes elapses, the 15-minute timer circuit 65 outputs a signal for putting the controller power supply switch 64 to the power supply switch detection circuit 63 and cuts the power supply of the controller 50.

On the other hand, the remaining nails sensor switch 58 that detects the low quantity of nails remaining within the magazine 6 is connected to the detection circuit 68, and the output signal of the detection circuit 68 is inputted to the second FET drive circuit 62 and the display circuit 70. When the quantity of nails remaining is low, the second FET drive circuit 62 exerts control so that the second FET 52 does not go on in order to prevent the nails from running out and causing empty driving in advance and the display circuit 70 displays that the quantity of nails is low.

The logic circuit 60 and the first FET drive circuit 61 form a first control system circuit. The first control system circuit controls the first FET 51 to go on and off based on an input signal from the trigger switch 54 and the push switch 55. The microcomputer 53 and the second FET drive circuit 62 form a second control system circuit that controls the second FET 52. The time where the first FET 51 is controlled to be in the on state by the first control system circuit is set to be longer than the time the second FET is controlled to be in an on state by the second control system circuit.

[An Example Circuit for the First Control System Circuit]

Figure 12:
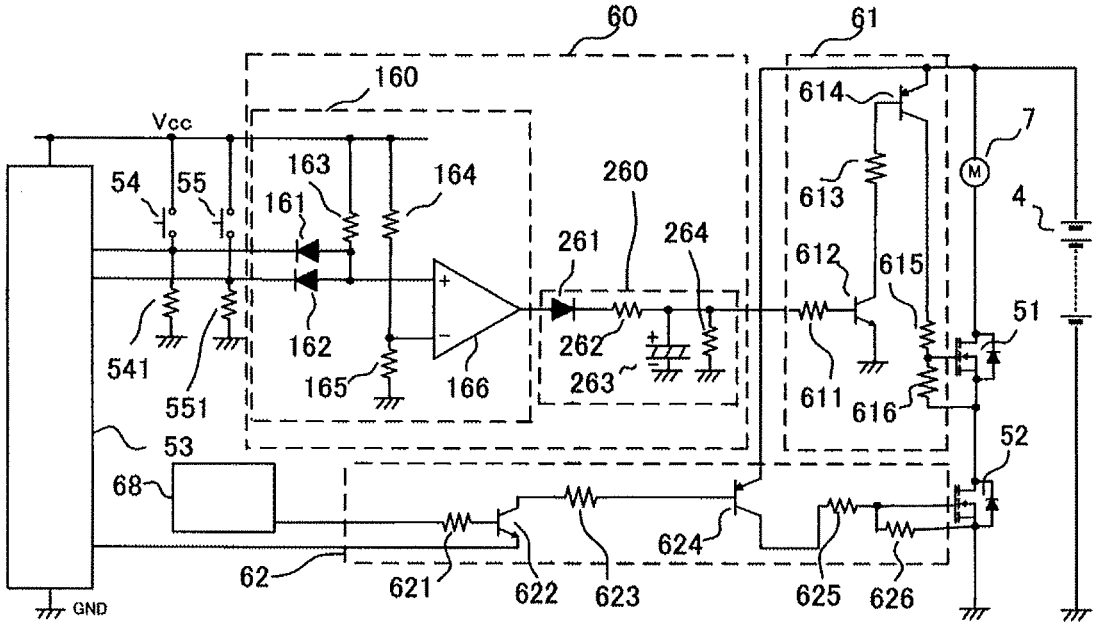
FIG. 12 is a circuit diagram showing an example of the control circuit used in the controller shown in FIG. 1.

A specific example circuit for the first control system circuit formed by the logic circuit 60 and the first FET drive circuit 61 is shown in FIG. 12. In FIG. 12, the second FET drive circuit 62 that controls the second FET 52 and other circuits are not shown.

As shown in FIG. 12, the logic circuit 60 includes an AND logic circuit 160 and an off delay circuit 260. The trigger switch 54 and the push switch 55 constitute an input unit of the logic circuit 60. One end of the trigger switch 54 and the push switch 55 is connected to a controller power supply Vcc and the other end is connected to ground via resistors 541 and 551. A connection point of the resistor 541 and the trigger switch 54 is connected to a microcomputer 53 and a cathode of the diode 161 and goes to a power supply potential Vcc or ground potential in response to the trigger switch 54 going on or off. The microcomputer 53 is capable of detecting the operation of the trigger switch 54. An anode of the diode 161 is connected to the power supply Vcc via the resistor 163, and is also connected to a non-inverting input terminal (+) of the operational amplifier 166 and an anode of the diode 162. A resistance of the resistor 163 is set to be large compared to the resistor 541 (approximately ten times the resistance of the resistor 541). When the trigger switch 54 is off, a voltage of a tenth or less of the power supply voltage Vcc is applied to the terminals of the microcomputer 53. The microcomputer 53 is capable of recognizing when the trigger switch 54 is on. A voltage Vcc is applied to the input terminal of the microcomputer 53 when the trigger switch 54 is on. The microcomputer 53 is therefore capable of recognizing when the trigger switch 54 is on. An input circuit formed from the push switch 55, the resistor 551, and the diode 162 operates in the same way as the input circuit for the trigger switch 54.

The inverting input terminal (−) of the operational amplifier 166 is connected to the power supply voltage Vcc via a resistor 164 and is connected to ground via the resistor 165. A voltage for the voltage dividing ratio of the resistor 164 and the resistor 165 for the voltage Vcc is applied to the non-inverting input terminal (−) of the operational amplifier 166 and a divided voltage is set to a substantially intermediate voltage for the power supply voltage Vcc. This means that when one of either the trigger switch 54 or the push switch 55 is off, a current flows to ground via one of the resistor 541 or the resistor 551 or via both resistors to ground. This means that a smaller voltage than is applied to the inverting input terminal (−) is applied to the non-inverting input terminal (+) of the operational amplifier 166 and the operational amplifier 166 therefore outputs a low (Low) level.

Conversely, when the trigger switch 54 and the push switch 55 are both on, the cathode terminals of the diode 161 and the diode 162 are the power supply voltage Vcc. This means that the diodes 161 and 162 are both biased to a non-conducting state. As a result, an input voltage near to the power supply voltage Vcc is supplied to the non-inverting input terminal (+) of the operational amplifier 166 via the resistor 163 and the operational amplifier 166 therefore outputs a high (High) level. The AND logic circuit 160 therefore outputs the AND of the switch state of the trigger switch 54 and the push switch 55.

The off delay circuit 260 includes an input diode 261, a charging resistor 262, a capacitor 263 for accumulating an output voltage for a high-level of the AND logic circuit 160, and a discharge resistor 264. A time constant for the charging resistor 262 and the capacitor 263 is set to be small compared to the time constant for the discharge resistor 264 and the capacitor 263.

When the AND logic circuit 160 outputs a high-level voltage, the capacitor 263 is charged comparatively quickly via the diode 261 and the charging resistor 262, and the off delay circuit 260 outputs a high-level output voltage. It is preferable for the delay time at this time to be made as short as possible. For example, in the order of 10 milliseconds to 50 milliseconds is appropriate. On the other hand, when the AND logic circuit 160 outputs a low level voltage, the charge of the capacitor 263 is discharged via the resistor 264. The discharge time constant for the capacitor 263 is large so the delay time therefore becomes long. This delay time is preferably set to is or less, and in particular is preferably set in a range, from 100 milliseconds to 500 milliseconds. This delay time is set to a time longer than the spring compression time for after driving in described later.

The first FET drive circuit 61 includes a PNP transistor 614 and an NPN transistor 612. Voltage dividing resistors 615 and 616 are connected to the gate (control electrode) of the first FET 51 so as to form a load resistor for a transistor 614. When the transistor 614 is on, the first FET 51 goes on. A collector of the NPN transistor 612 is connected to the base of the transistor 614 via a base current limiting resistor 613. The base of the NPN transistor 612 is connected to the output of the off delay circuit 260 via the base current limiting resistor 613 and the emitter of the transistor 612 is connected to ground. With this circuit configuration, when the logic circuit 60 outputs a high-level voltage, the NPN transistor 612 and the PNP transistor 614 go on and the first FET 51 also goes on.

The first control system circuit constituted by the logic circuit 60 and the first FET drive circuit 61 has the off delay circuit 260. This means that the first FET 51 remains on for the prescribed time Th (refer to FIG. 13) without the first FET 51 going off immediately even if one of the trigger switch 54 or the push switch 55 (in this embodiment, the push switch 55) is turned off. The first FET 51 therefore remains on within the prescribed time Th after the nail is driven in. The motor 7 is therefore driven and the plunger 8 is moved to a prescribed position for before the nail is driven in while compressing the drive spring 9.

[An Example Circuit for the Second Control System Circuit]

Next, an explanation is given of a specific example of a circuit for a second control system circuit constituted by the microcomputer 53 and the second FET drive circuit 62 by again referring to FIG. 12. The second FET drive circuit 62 includes a PNP transistor 624 and an NPN transistor 622. Voltage dividing resistors 625 and 626 are connected to the gate of the second FET 52 so as to form a load resistor for a transistor 624. This configuration is such that the second FET 52 goes on as a result of the transistor 624 going on. A collector of the NPN transistor 622 is connected to the base of the transistor 624 via a base current limiting resistor 623.

The base of the NPN transistor 622 is connected to the output of the detection circuit 68 via the base current limiting resistor 621. The emitter of the transistor 622 is connected to the microcomputer 53. The remaining nails detection circuit 68 outputs a high (High) level when a certain quantity of nails remain, and outputs a low (Low) level when the quantity of nails remaining is small. With this circuit configuration, when the output of the remaining nails detection circuit 68 is a high level, and when the output of the microcomputer 53 is a low level in response to the trigger switch 54, the push switch 55, and the operation detection switch 56, the NPN-type transistor 622 and the PNP-type transistor 624 are put on, and the second FET 52 is put on.

On the other hand, when the operation detection switch 56 is turned on, a pulsed voltage is supplied from the microcomputer 53 to the emitter of the NPN transistor 622 in response to the detection signal of the operation detection switch 56. The microcomputer 53 then supplies a PWM (Pulse Wave Modulation)-controllable pulsed voltage to the emitter of the NPN transistor 622 using a pulse frequency of, for example, 50 Hz, based on the switch signal of the operation detection switch 56. As a result, the second FET 52 is switched and the motor 7 is pulse-driven. As a result, the motor 7 is subjected to speed control by the PWM control of the second FET 52 and the speed is reduced. Well-known technology is applicable as the pulse drive method for this motor.

[Operation of the Controller 50]

Figures 13A, 13B, 13C, 13D, 13E, 13F, 13G, 13H:
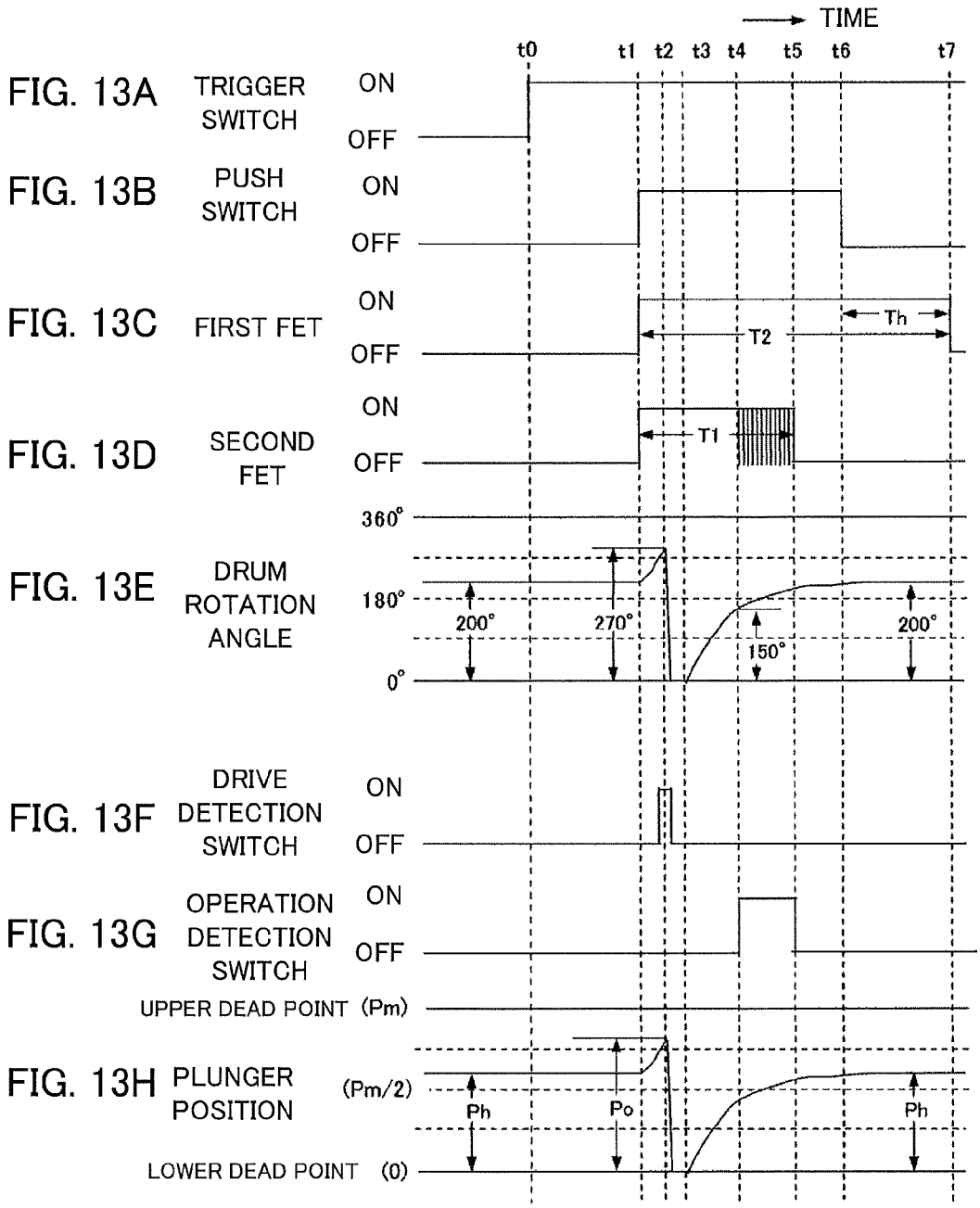
FIGS. 13A to 13H are timing diagrams of the operation of the fastener driving tool of the embodiments of the present invention.

Next, an explanation is given of the operation of the controller 50 with reference to the timing diagrams shown in FIGS. 13A to 13H. In the initial state before driving (before time t0), as shown in FIG. 13E, the drum 13 of the spring compression drive unit 81 is stopped rotated approximately 200 degrees from the reference state (state of zero degrees) shown in FIG. 7. First, at the time t0, the trigger switch 54 goes on. Next, at a time t1, when the push switch 55 goes on, the input of the AND logic circuit 160 puts the trigger switch 54 and the push switch 55 both on and the AND logic circuit 160 outputs a high level. The output of the AND logic circuit 160 is then delayed by the off delay circuit 260 and the output of the logic circuit 60 is changed to a high-level output voltage. As a result, the transistors 612 and 614 of the first FET drive circuit 61 both go on and the first FET 51 also goes on.

On the other hand, the microcomputer 53 constituting the second control system circuit also detects that the trigger switch 54 and the push switch 55 are on, and puts the second FET 52 on via the second FET drive circuit. At time t1, the first FET 51 and the second FET 52 are both switched on at a time t1. The electrical power is supplied to the motor 7 by the battery pack 4 and the motor 7 starts to rotate. When the motor 7 rotates, the drive power of the motor 7 is transmitted to the drum 13 of the spring compression drive unit 81 via the reduction mechanism unit 80. The drum 13 rotates in the forward rotation direction A so as to wind up the wire 16, the plunger 8 is pulled up, and the spring 9 is compressed.

At time t1 to time t2, the drum 13 rotates approximately 270 degrees from the reference state shown in FIG. 7. When the plunger 8 then moves to a drive start position close to the upper dead point Pm, at the time t2, as shown in FIG. 9, engagement of the power transmission pin 17 and the hook section 22*a* is released. The drum 13 is therefore in a freely rotating state with respect to the rotating axis 19 without being subjected to the drive power of the motor 7. This is to say that the drum 13 is separated from the rotation output shaft 19 that the drive power of the motor 7 is transmitted to as a result of the clutch function of the spring compression drive unit 81. The time for from the time t1 to the time t2 of FIG. 13 influences the drive feeling. It is therefore preferable to set the time to be 200 milliseconds or less, and according to this present invention, the time may be set to, for example, 100 milliseconds or less.

As a result, at time t2 to time t3, the plunger 8 compressed by the spring 9 is released. The blade 8*a* of the plunger 8 then strikes the nail 23 as a result of the urging force of the spring 9 and the nail 23 is driven into the member to be fastened. At this time, the nail driving detection switch 57 is put on by the drum damper engaging section 13*a* (refer to FIG. 2) provided at the drum 13 at time t2 and the time of driving in the nail 23 is detected.

At the time t3 after driving in the nail, the power transmission pin 17 of the spring compression drive unit 81 and the hook section 22*a* are in reengagement, and the rotating output shaft 19 outputting the drive power of the motor 7 is mechanically coupled to the drum 13. At this time, the first FET 51 and the second FET 52 are both on. The operation of the motor 7 is therefore maintained, the drum 13 is rotated in the direction A that winds up the wire, and the spring 9 is compressed again. When the drum 13 is rotated from the reference state through approximately 150 degrees, at time t4, the rotation pressing unit 56*b* puts the operation detection switch 56 on.

When the operation detection switch 56 is put on at the time t4 (refer to FIG. 13G), the microcomputer 53 receives the rising edge of the on signal as the first detection signal. The microcomputer 53 then drives the second FET 52 at a pulsed voltage of approximately 50 Hz and starts PWM control.

In the PWM control from time t4 to time t5, the microcomputer 53 calculates the voltage of the motor 7, i.e. the rotational speed based on the input of the motor voltage detection circuit 69 for the time that the second FET 52 is off. The microcomputer 53 then decides the duty cycle for the PWM control using the PI control (proportional integral control) so that the rotational speed of the motor 7 becomes a prescribed value (set value) or less and pulse-drives the second FET 52 via the second FET drive circuit 62 so as to go on for a prescribed time. The microcomputer 53 then detects the rotational speed of the motor 7 by repeating the PI control and decides the duty cycle, and the speed of the motor 7 is reduced by putting the second FET 52 on for a prescribed time.

At time t5, when the drum 13 is rotated to the vicinity of 190 degrees from the reference state and the spring 9 is compressed, the drum damper striking section 13*a* puts the operation detection switch 56 off. The microcomputer 53 then receives the rising edge at the time of the operation detection switch 56 going off as a second detection signal, puts the second FET 52 off via the second FET drive circuit 62, and stops energizing the motor 7.

Even if the excitation of the motor 7 is stopped at the time t5, as shown in FIG. 13E, the drum 13 continues to turn as a result of the slight rotational inertia of the reduction mechanism unit 80, the spring compression drive unit 81, and the drum 13 etc. The plunger 8 is then further moved to the side of the upper dead point and the spring 9 is compressed.

At a time t6, when the rotational speed due to the rotational inertia becomes zero, the drum 13 attempts to rotate in the reverse rotation direction B as a result of the urging force of the spring 9. However, the drum 13 is stopped and supported in a state where the plunger 8 is pulled by the reverse rotation prevention function of the one-way clutch 24. As a result, the drum 13 is stopped at a rotational angle for the initial state of approximately 200 degrees (refer to FIG. 13E) and the plunger 8 is stopped at the prescribed position (compression start position) Ph of the initial state. When the push switch 55 is also put off at the time t6, the first FET 51 is put off at a time t7 by the off delay function of the off delay circuit 260 after an off delay time Th elapses, and the drive cycle ends.

According to this embodiment, the rotational speed of the motor 7 becomes a prescribed value or less when excitation is stopped at the time t5 and the rotational energy of the motor 7 becomes small. The amount of compression of the spring 9 is therefore small based on the rotational inertia after stopping of excitation of the motor 7, and variations in control are not influenced by the batter voltage etc. of the battery 4 and can therefore be made small. It is therefore possible to make the rotation stop angle (for example, 200 degrees) of the drum 13 set in advance close to the drive start rotation angle (for example, 270 degrees) occurring at the time t2 of driving in the nail when the plunger 8 is released. As a result, as shown in FIG. 13H, the position of the plunger 8 to be stopped can be set to a stop position (Ph) that is a half (Pm/2) or more of the position Pm of the upper dead point and can be made as close as possible to the drive start position (Po).

The stop position Ph of the plunger 8 can therefore be set to be close to the drive start position Po. The time up until the actual driving with respect to the drive operation occurring in the next nail driving cycle can therefore be made fast and the driving feeling can be improved. According to this embodiment, it is possible to set the operation time T1 (time from time t1 to time t5) shown in FIG. 13 to 200 milliseconds to 1 second, with the driving feeling being markedly improved for the case of setting in a range of 200 milliseconds to 500 milliseconds.

The reduction in speed due to the pulse driving of the motor 7 may also be achieved by the microcomputer 53 driving the second FET 52 at a duty cycle of the prescribed value based on the detection signal when the operation detection switch 56 is on, with a voltage applied to the motor 7 being substantially low. A fixed value decided in advance can be used as the duty cycle of the pulse drive method or a duty cycle calculated from the rotational speed of the motor 7 detected by the motor voltage detection circuit 69 when the operation detection switch 56 is on can be used. In this case, it is possible to use a comparatively cheap microcomputer compared to the control where the duty cycle is sequentially changed using PI control. In this embodiment, the period of starting the reduction in speed in this embodiment is the time t4 when the operation detection switch 56 output is on. The timing for starting the reduction in speed does not depend on the output of the operation detection switch 56, and the timing may also be after elapsing a prescribed time (for example, the time within the range of time t2 to t4) that is after the output of the nail driving detection switch 57.

According to this embodiment, it is possible to compress the drive spring 9 to the stop position Ph of the initial state of the plunger 8 close to the drive start position Po even if the drive spring 9 is given a spring energy greater than that of the related art such as, for example, 5 to 10 times the spring energy of the related drive spring 9. The spring compression time (time from time t1 to time t2) before driving at the next drive cycle can be made short. It is therefore possible to make the time from the operation of the drive operation switch of the push switch 55 etc. to the actual driving short and the feeling of the driving can be improved. In particular, it is possible to provide a driving tool with superior drive feeling with no time lag when operating in consecutive mode operation where a large number of nails are driven in one after another.

According to this embodiment, the off delay circuit 260 constituting the logic circuit 60 (first control system circuit) is provided so that the first FET 51 does not immediately go off even if the push switch 55 goes off, with the first FET 51 being kept on a prescribed time Th after the push switch 55 goes off. As a result, even if the push switch 55 goes off before the time where the second FET 52 goes off, the time T2 (refer to FIG. 13C) of the on state of the first FET 51 can be held for longer than the time T1 (refer to FIG. 13D) of the on state of the second FET 52. Electrical power is then supplied to the motor 7 for a prescribed time (T1). As a result, as shown in FIG. 13H, the position of the initial state of the plunger 8 can easily be controlled to be at the position Ph that is ½ or more of the maximum position Pm. In particular, the function for holding the on state for the prescribed time Th by the first control system circuit (the logic circuit 60 and the first FET drive circuit 61) gives effective results for the continuous mode nail driving operation where cases where the on time of the push switch 55 (time from the time t1 to the time t6) is shorter than the on time T1 of the second FET 52 are common.

According to this embodiment, it is possible to prevent erroneous operation of the motor 7 even if one of the first FET 51 or the second FET 52 is subject to a common semiconductor element failure such as thermal destruction and the reliability of the operation can therefore be ensured.

As becomes clear from the above embodiment, according to the present invention, the rotational speed of the motor is reduced to a prescribed value or less based on the detection signal of the operation detection switch when the plunger is moved to a prescribed position for an initial state at the upper dead point side again by the drive power of the motor after having been moved to the lower dead point side, and the motor at the reduced speed is then stopped. The stop position of the plunger after ending driving can be controlled to be a prescribed position (Ph) as close as possible to the drive start position (Po). As a result, when the drive cycle ends, the drive spring is reliably compressed so as to have a prescribed drive energy, and the spring compression time for the next drive cycle can be made short. The overall drive time can therefore be made short. The drive feeling is therefore improved.

At least a pair of semiconductor switching elements can be used as motor drive semiconductor switching elements, or respective semiconductor switching elements can be controlled using independent pairs of control system circuits. The reliability of the stop state of the fastener driving tool is therefore improved.

The above embodiment of the present invention is applied to trigger switches and push switches taken as operation switches but application to other operation switches is also possible. Further, a description is given of the case where the trigger switch is given priority over the push switch but the same configuration is also possible giving priority to operation of the push switch. Switches that are normally off are used as the trigger switches and the push switches but the present invention is also applicable to switches that are normally on.

A detailed description is given by the applicants based on the embodiment of the invention but the present invention is by no means limited to the above embodiment and various modifications are possible within the essential scope of the present invention. Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application claims priority based on Japanese Patent Application No. 2008-005533 filed on Jan. 15, 2008, the entire disclosure of which is incorporated herein by reference in its entirety.

What is claimed is:

1. A fastener driving tool comprising:

a motor;

a DC power supply that supplies electrical power to the motor;

a magazine that supplies fasteners to a nose;

a plunger that is driven by the motor to move between an upper dead point and a lower dead point;

a blade connected to the plunger for driving the fasteners supplied to the nose;

a drive spring that urges the plunger downwards, and that is capable of being compressed upwards;

a spring compression drive unit that moves the plunger in a compression direction of the drive spring using a drive force of the motor, and that moves the plunger downwards by releasing the compressed spring;

a first operation switch that detects a first user operation;

a second operation switch that detects a second user operation;

an operation detection sensor that detects a drive state of the spring compression drive unit to produce a detection signal; and a controller that controls starting, stopping, and rotational speed of the motor based on detection signals from the first operation switch, the second operation switch, and the operation detection sensor, the controller including means for providing a pulse width modulation signal to the motor to reduce the rotational speed of the motor based on the detection signal which is output from the operation detection sensor when the operation detection sensor detects that the plunger is moved again to an initial position close to the upper dead point by the drive force of the motor after the plunger is moved to the lower dead point.

2. The fastener driving tool according to claim 1, wherein the controller reduces the rotational speed of the motor to a prescribed value or less during on-state of the detection signal of the operation detection sensor.

3. The fastener driving tool according to claim 2, wherein the operation detection sensor outputs a first level of the detection signal when the spring compression drive unit moves the plunger to a first prescribed position, and outputs a second level of the detection signal when the spring compression drive unit moves the plunger to a second prescribed position that is closer to the upper dead point than the first prescribed position.

4. The fastener driving tool according to claim 1, wherein the controller reduces the rotational speed of the motor to a prescribed value or less by converting the voltage supplied by the DC power supply to the motor into a pulsed voltage.

5. The fastener driving tool according to claim 4, further comprising a speed detection device that detects a rotational speed of the motor, wherein the controller varies the pulse width of the pulse width modulation signal based on a rotational speed detected by the speed detection device.

6. The fastener driving tool according to claim 1, wherein the controller controls the motor so that the time required for the plunger to move from the lower dead point to the initial position is within a range of 200 milliseconds to one second when the rotational speed of the motor is reduced to a prescribed value or less.

7. The fastener driving tool according to claim 1, wherein the first operation switch is a trigger switch that detects a trigger operation of user, and the second operation switch is a push switch that detects a contact of the nose with a member to be fastened.

8. The fastener driving tool according to claim 1, wherein the DC power supply supplies electrical power to the motor via a semiconductor switching element, and wherein the controller reduces the rotational speed of the motor to a prescribed value or less by rendering the semiconductor switching element on and off based on the detection signal from the operation detection sensor.

9. The fastener driving tool according to claim 1, the spring compression drive unit comprising a rotating body that moves in cooperation with the plunger and that rotates in a prescribed rotation direction based on the drive force of the motor, and a clutch that transmits or disengages the drive force of the motor to or from the rotating body, wherein the clutch:

transmits the drive power of the motor to the rotating body while the rotating body rotates to the prescribed angle in the prescribed rotation direction; and the clutch disengages transmission of the drive force of the motor to the rotating body when the rotating body is rotated in the prescribed rotation direction so as to reach the prescribed angle, and the compression spring drive unit:

moves the plunger in the compression direction of the drive spring using the rotating body when the clutch is in a transmission state; and releases the compressed drive spring so as to move the plunger to the lower dead point when the clutch is switched over to a disengaged state.

10. The fastener driving tool according to claim 9, wherein the clutch transmits the drive power of the motor to the rotating body while the rotating body rotates in the prescribed rotation direction from a second prescribed rotation angle of the rotating body corresponding to the lower dead point position of the plunger to the prescribed angle.

11. The fastener driving tool according to claim 1, wherein the controller controls the rotational speed of the motor so that the plunger stops at a position that is half or more of the heights of the upper dead point.

12. A fastener driving tool comprising:

a motor;

a power supply that supplies electrical power to the motor;

a magazine that supplies fasteners to a nose;

a plunger that is driven by the motor to move between an upper dead point and a lower dead point;

a blade connected to the plunger for driving the fasteners supplied to the nose;

a drive spring that urges the plunger downwards, and that is capable of being compressed upwards;

a spring compression drive unit that moves the plunger in a compression direction of the drive spring using the motor, and that moves the plunger downwards by releasing the compressed drive spring;

an operation switch that detects a user operation;

an operation detection sensor that detects a drive state of the spring compression drive unit;

a driving detection switch that detects driving of the fastener; and a controller that controls the motor based on detection signals from the operation switch, the operation detection sensor, and the drive detection switch, wherein the controller supplies a pulse width modulation signal to the motor to reduce the speed of the motor when the operation detection sensor detects that the plunger is moved to a first prescribed position by the spring compression drive unit after detection of driving of the fastener by the drive detection switch, and the controller stops the supply of electrical power from the power supply to the motor when the operation detection sensor detects that the plunger is moved to a second prescribed position above the first prescribed position by the spring compression drive unit during reduced speed of the motor.

* * * * *